US006637614B2

(12) United States Patent
Bergkvist

(10) Patent No.: US 6,637,614 B2
(45) Date of Patent: Oct. 28, 2003

(54) CHILD'S PLATE

(75) Inventor: Håkan Bergkvist, Bromma (SE)

(73) Assignee: Baby Björn AB, Danderyd (SE)

( * ) Notice: Subject to any disclaimer, the term of this patent is extended or adjusted under 35 U.S.C. 154(b) by 0 days.

(21) Appl. No.: 10/296,749

(22) PCT Filed: Jun. 7, 2001

(86) PCT No.: PCT/SE01/01275

§ 371 (c)(1),
(2), (4) Date: Nov. 27, 2002

(87) PCT Pub. No.: WO01/95771

PCT Pub. Date: Dec. 20, 2001

(65) Prior Publication Data

US 2003/0150865 A1 Aug. 14, 2003

(30) Foreign Application Priority Data

Jun. 16, 2000 (SE) ..... 0002257

(51) Int. Cl.[7] ..... A47G 19/00; A47G 21/00
(52) U.S. Cl. ..... 220/574
(58) Field of Search ..... 220/574, 574.1, 220/574.3

(56) References Cited

U.S. PATENT DOCUMENTS

| | | | | |
|---|---|---|---|---|
| 3,527,192 A | | 9/1970 | Ferrara | 119/61 |
| 3,622,036 A | | 11/1971 | Bongaerts | 220/70 |
| 3,722,476 A | | 3/1973 | Van Ness et al. | 119/61 |
| 5,172,826 A | * | 12/1992 | Celaya | 220/574 |
| 5,269,717 A | * | 12/1993 | Tardif | 446/71 |
| 5,813,638 A | * | 9/1998 | Morris | 248/152 |
| 6,032,824 A | | 3/2000 | Barrow | 220/621 |
| 6,401,955 B1 | * | 6/2002 | Yang | 220/23.87 |
| 6,431,389 B1 | * | 8/2002 | Jerstroem et al. | 220/574.3 |

FOREIGN PATENT DOCUMENTS

DE 2 248 436 4/1974

* cited by examiner

*Primary Examiner*—Joseph M. Moy
(74) *Attorney, Agent, or Firm*—Jacobson Holman PLLC

(57) ABSTRACT

A child's plate includes a food bowl (10) which is supported by a surrounding raised rim (1) one upper edge-part (3) of which connects with the upper edge-part (11) of the bowl (10) and the other, lower rim part (2) of which defines a support plane (4) with which the rim rests on a planar support surface around the whole of its periphery. The rim (1) is adapted to support the bowl (10) above the support surface. The rim (1) slopes outwardly and downwardly from its upper edge towards its bottom edge (2). The inner wall surface of the bowl (10) and the outer wall surface of the rim (1) define a downwardly divergent angle of at least 20°. The bottom edge (5) of the rim (1) includes friction enhancing means (3) which counteracts displacement of the plate (1) on a planar support surface on which the plate rests. The vertical wall surface (12) of the bowl has in the vicinity of the free edge of the bowl wall a surface part (15) against which a perpendicular force can be applied with the finger of one hand. The bottom edge part (15) is spaced from an adjacent part of the bottom edge of the rim by a distance of at least 2 cm.

5 Claims, 2 Drawing Sheets

FIG 3
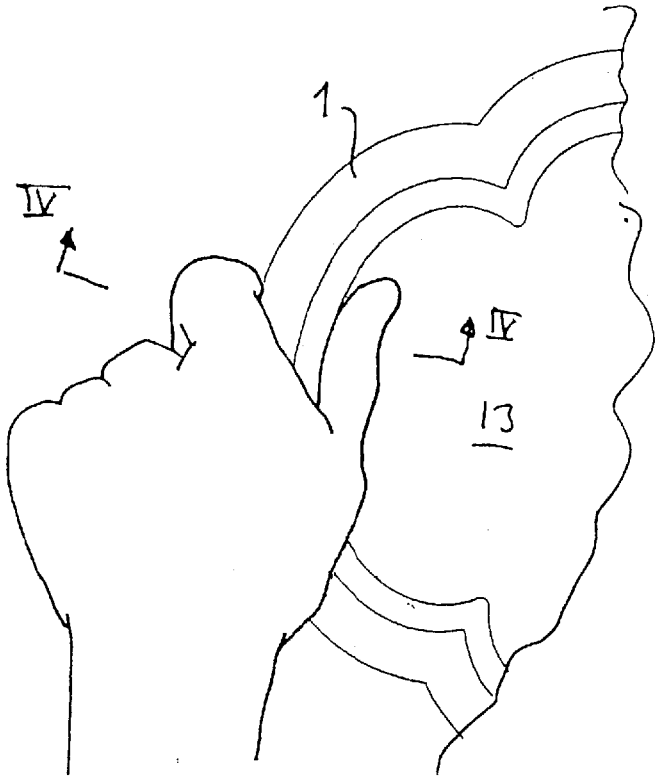
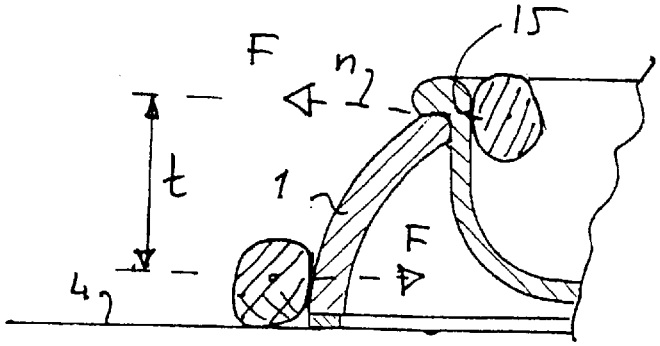
FIG 4

CHILD'S PLATE

This is a nationalization of PCT/SE01/01275, filed Jun. 7, 2001 and published in English.

The invention relates to a child's plate of the kind defined in the preamble of claim 1 (DEA-2248436).

Thus, the invention relates to a child's plate of the kind that comprises a bowl which is carried by a surrounding raised rim of which an upper edge-part connects with an edge-part of the bowl and which defines with its lower edge-part a support plane, wherein the raised rim is adapted to support the bowl above said plane, and wherein the outer surface of the raised rim slopes outwardly and downwardly from the upper edge of said rim towards the support plane, and wherein the bowl has an inner wall which defines an angle of at least 20° with the outer surface of the rim.

A typical plate that includes a central bowl which is intended to rest on a support surface and which has a circumferentially and radially outwardly extending flange at its free end can be easily tipped over (e.g. by exerting a downward force on the flange), gripped and lifted even by a small child, therewith spilling the food on the plate. The plate may even be thrown by a child gripping the plate.

U.S. Pat. No. 6,032,824 teaches a plate intended for household pets and small children. This plate includes an upwardly tapering conical rim which supports a bowl whose inner wall has a radially downwardly bent rim part that forms a splash guard for liquid in the bowl. It will be noted, however, that even a small child can firmly grip around the splash guard rim of the bowl and readily tip or throw the bowl. Moreover, the bowl can readily be moved along the support surface, since it lacks the provision of friction devices that make such movement difficult to achieve.

U.S. Pat. No. 3,622,036 teaches a dog feeding bowl of the design defined in the preamble of claim 1.

With the intention of preventing to some extent a small child from spilling food from a child's plate, for instance by tipping or gripping and lifting the plate, it has been found suitable to design a child's plate fundamentally in a manner corresponding to the design taught by U.S. Pat. No. 3,622,036. However, bowls/plates of such nature have been found to have certain drawbacks. One drawback is that the known plate/bowl slides easily on a plate/bowl supporting surface. When the construction of a child's plate allows the plate to slide on a support surface, a child can easily push the plate/bowl away so as to cause food to spill from the plate and the plate to slide over the table edge. And if the plate known from U.S. Pat. No. 3,622,036, should be provided with a slide guard on the undersurface of the plate, the problem arises that it the slide guard causes the rim of the plate to be raised from the plate support plane, a child will be able to grip beneath the bottom edge of the rim with his/her nails and lift or topple the plate/bowl, and so on. If an attempt to solve this problem is made by fitting an essentially continuous string of friction material around the bottom edge of the rim, said string resting along/around its entire length against said support surface (preventing a child from gripping with his/her nails against said string or between the string and the support surface), it is practically impossible for an adult to lift the plate (bowl) from the support surface with one hand, particularly since the plate/bowl cannot be easily moved on the support surface.

Moreover, it is practically impossible for a child or an adult to spoon solid/semi-solid food from a plate of rotational-symmetrical design, for instance the bowl taught by U.S. Pat. No. 3,622,036.

DE-A-2248436 teaches a plate that has large openings in the plate rim, said plate being able to rest on the support surface via rubber feet.

Accordingly, the object of the present invention is to provide a child's plate which essentially prevents a child from pushing away his/her plate across a smooth table surface, and which prevents a child from gripping the plate in a manner which enables the plate to be lifted, toppled, etc., and which, in spite of this, can still be gripped by an adult in one hand and lifted from the table surface.

Another object of the invention is to provide a child's plate from which food can be readily taken by means of cutlery, such as a spoon.

Further objects will be apparent, either directly or indirectly, from the following description.

The objects of the invention are achieved with a child's plate constructed in accordance with the present invention.

The inventive plate is defined in the accompanying dependent claim.

Further embodiments of the invention will be apparent from the accompanying dependent claims, the description, and from the drawings.

Basically, the invention resides in that the exposed outer surface edge-part of the plate slopes upwards/inwards at an angle of at least 20° to a normal of the plate support plane, so that the hand of a child will not normally be able to grip the plate edge in a manner which allows the plate to be lifted. Moreover, the radially outer wall surface of the plate shall extend right down to the plate support surface, so as to exclude the presence of a gap between the under edge of the peripheral wall of the plate and a flat surface, such as a table surface, on which the plate rests, at any point around the plate circumference, so that a child will not be able to grip, e.g. with a fingernail, between the plate and the support surface. Moreover, the bottom edge of the radially outer peripheral wall of the plate shall be comprised of a friction-enhancing material, such as an elastomeric material, which functions to prevent sliding/movement of the plate over an essentially flat table surface.

The radially and inwardly facing free wall surface of the plate bowl also includes in the proximity of the bowl edge a surface part whose normal extends at a significant distance from the region between the plate support plane and the lower edge-part of the raised rim. This enables an adult to place the outside of the index finger of one hand in an angular region between a plate support surface and the exposed bottom edge-part of the raised rim, wherewith the adult concerned can place the pad of the outer thumb joint on the same hand on said outer part. The adult is then able to readily apply with this hand a rotary force that will cause the plate to swing up from the plate support surface/the table surface around the part of the plate gripped by this hand. A small child normally has a hand-gripping function which involves gripping an object between all fingers and the wrist, wherewith the conical edge-part of the plate makes it impossible in practice for the child to obtain a firm grip on the exposed edge-part of the plate. In practice, the bowl wall of the plate may be essentially at right angles to the plate support plane, with the bottom of the bowl, or dished part of the plate, generally parallel with said plate support plane, at least in the vicinity of the bowl wall, so as to facilitate eating from the plate with a spoon that is moved radially outwards in the bowl.

With the intention of further facilitating taking food from the bowl-like part of the plate, said part may conveniently include around its periphery mutually spaced projections that extend radially inwards towards the centre of the plate, these projections preventing food from being moved around the periphery of the bowl as a spoon is moved around the bowl wall.

For cleaning purposes, the plate may include a bowl which is inserted removably in a surrounding ring-shaped rim, so as to enable the bowl and rim to be washed effectively per se, either by hand or in a dishwasher.

The invention will now be described by way of example with reference to the accompanying drawings.

FIG. 3 is a view corresponding to that of FIG. 1, but also showing a hand applied to lift the plate from a plate support surface.

FIG. 4 is a sectional view taken on the line IV—IV in FIG. 3.

Figure 2:
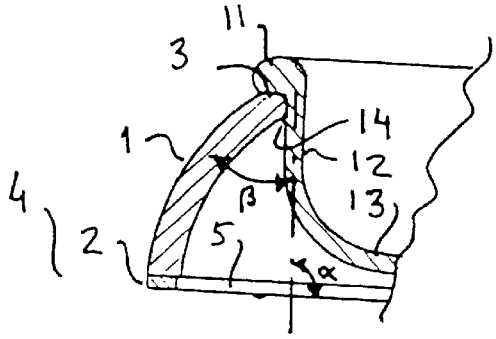
FIG. 2 is a sectional view taken on the line II—II in FIG. 1.

The plate includes a ring-shaped wall which has its bottom edge located in a plane that defines the plane of the surface supporting the plate. The wall, or raised rim, has an outer surface which tapers conically in a direction away from the support plane. The upper edge of the wall or raised rim 1 forms a support for a carrier flange 11 that extends radially outwards from the upper edge part of a generally ring-shaped wall 12 of a bowl 10, the bottom 13 of which is generally plane-parallel with the support plane 4 of the wall 1, and thus also of the plate, wherewith the bottom 13 of the bowl is spaced above the plane 4. The bottom edge 2 of the wall/raised rim 1 is comprised of an elastomeric string 5 that extends completely around the raised rim. The radially inner wall surface of the bowl 10 (at least the upper part of said wall surface) extends generally at right angles to the support plate 4, the height of the plate from said support plane preferably being about 3 cm. It will be seen from the sectional view of FIG. 2 that the angle β between the inner surface of the wall 12 and the outer surface of the wall 1 is greater than 20°, preferably about 30°.

It will also be seen that the angle α between the bottom wall surface of the bowl and the plane 4 in axial section to the plate is essentially a right angle (roughly 90°). The size of the edge flange 11 of the bowl 2 is adapted to the support edge of the raised rim, so as not to provide a grip for a child's hand. Provided on the outside of the bowl wall 12, in the region beneath the flange 11, are projections 14 which provide a snap-fastener facility for detachably holding the bowl 10 to the raised rim 1.

As will be seen from FIG. 4, the inner wall surface of the bowl, at its the upper edge, has a part 15 which preferably extends around the inner periphery of the bowl and which is generally perpendicular to the plane 4 in the illustrated sectional view. An adult can, for instance, place the thumb of one hand along the inner wall of the bowl in the part 15, and press down against the part 15 with the finger pad on the outermost joint of the thumb, whilst, at the same time, folding over the index finger of the same hand so that the outermost joint of said finger will rest on the surface supporting the plate, with the nail of the index finger facing downwards and the outermost joint of the index finger positioned in the close proximity of the lower edge part of the raised rim 1. As will be seen from FIG. 3, the adult is now able to exert a pair of mutually parallel and counter-directional forces on the plate with his/her hand and with the finger parts positioned as shown. The force exerted by the thumb is normally applied in the proximity of the upper edge of the part 15. The forces F are spaced, apart at a distance t, which is generally about 2 cm, which applies to the illustrated embodiment. The index finger is guided by the table surface/the support surface in the illustrated direction, and the force exerted by the thumb is essentially perpendicular thereto, i.e. lies in the direction of the normal to the surface part 15, so as to enable a torque F×t to be established. This enables the plate to be tilted (lifted-up) from the plate support surface around the elastomeric string 5 in the illustrated sectional view, even when the plate weighs as much as 1 hg when empty and has a diameter of 15–20 cm. In the case of the illustrated embodiment, the force F can be applied to the inner wall at a distance from the plate support plane of at least 2 cm, and possibly a distance of 2.5 cm.

As will be evident from FIG. 2, the string of elastomeric material 5, which constitutes the bottom edge of the wall 1 and lies in contact with a flat support surface on which the plate rests around the full periphery of the wall, essentially prevents displacement of the plate over said support surface. Because the plate rim also denies any effective handgrip, even for an adult, due to the upwardly tapering and slightly rounded cross-section of the rim, and because the bowl flange 11 also denies any effective finger grip, the illustrated design is a necessary means for enabling an adult to lift-up the plate from a flat plate support surface.

The string of elastomeric material 5 may, of course, be replaced with some other friction-enhancing means, although an elastomer is preferred in practical embodiments.

The elastomeric string 5 may be fixed along the bottom edge of the structurally rigid ring-shaped wall 1. In one embodiment, the elastomeric string 5 may have downwardly extending projections of small diameters and heights distributed around the plate perimeter, such as to ensure that a relatively high surface pressure will be obtained against the support surface even when the plate is subjected to a relatively low vertical load. The small height of the projections (not shown) will conveniently be chosen so as to prevent a child from inserting a nail between the table surface and the elastomeric string 5.

Figure 1:
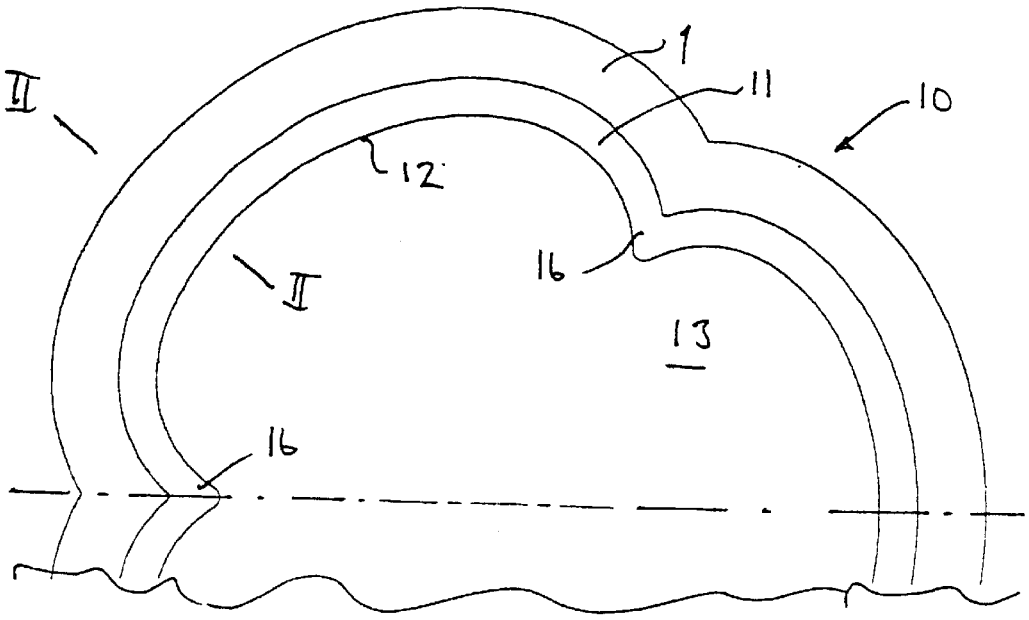
FIG. 1 is a schematic plan view illustrating an inventive child's plate from above.

As will be seen from FIG. 1, the bowl may include around its periphery a number of projections, for instance three, that extend essentially radially inwards to from three lobe-shaped peripheral bowl portions. The bowl wall 12 has a relatively small radius, in the order of 1.5 cm, at the ends of respective lobes, wherewith the wall part will extend around about 90° with a wall of this radius. There is established at the ends of the lobe-shaped part in this way corners in which an adult can comfortably lift food from the plate with a spoon that is moved into this corner, with a minimum of risk of food on the plate being displaced around the plate periphery.

The raised rim and the bowl lack openings that facilitate finger grips.

I claim:

1. A child's plate that includes a food bowl (10) which is supported by a surrounding raised rim (1) whose upper edge-part (3) connects with the upper rim-part (11) of the bowl (10) and whose bottom edge-part (2) defines a support surface (4) on which the rim rests on a flat support surface around its full perimeter, wherein the raised rim (11) is intended to support the bowl (10) above the flat support surface, wherein the raised rim (1) is inclined outwardly and downwardly from its upper edge to its lower edge (2), wherein the inner wall surface of the bowl (10) and the outer wall surface of the raised rim (1) define a downwardly divergent angle (β) of at least 20°, and wherein the plate is characterised in that the bottom edge-part (2) of the raised rim (1) is comprised of a friction-enhancing element (5) which extends around the rim periphery and counteracts displacement of the plate (1) on a flat support surface on which the plate rests; and in that the inner wall surface (12) of the bowl has in the vicinity of the free edge of the bowl wall a surface part (15) against which the thumb of an adult is able to apply a perpendicular force at a distance (t) of at least 2 cm above the bottom edge of the raised rim (1).

2. A child's plate according to claim 1, characterised in that the bowl (10) is mounted removably in the raised rim (1).

3. A child's plate according to claim 1, characterised in that the bowl wall (12) has a plurality of projections (16) that extend generally radially inwards, said projections being preferably mutually spaced around said periphery.

4. A child's plate according to claim 3, characterised in that the bowl projections (16) are disposed so as to delimit lobe-shaped peripheral parts on the bowl (10).

5. A child's plate according to claim 1, characterised in that at least the upper part of the inner wall (12) of the bowl defines generally a right angle with the plate support plane.

* * * * *